US006644518B1

(12) United States Patent
Cavallo

(10) Patent No.: US 6,644,518 B1
(45) Date of Patent: Nov. 11, 2003

(54) TEAR-OFF DEVICE FOR OPENING DRINK CANS

(75) Inventor: Vincenzo Cavallo, Via Gabelli, 14, I - 47900 Rimini (IT)

(73) Assignee: Vincenzo Cavallo, Rimini (IT)

( * ) Notice: Subject to any disclaimer, the term of this patent is extended or adjusted under 35 U.S.C. 154(b) by 0 days.

(21) Appl. No.: 09/979,002

(22) PCT Filed: Mar. 28, 2000

(86) PCT No.: PCT/IB00/00365

§ 371 (c)(1),
(2), (4) Date: Nov. 14, 2001

(87) PCT Pub. No.: WO00/69733

PCT Pub. Date: Nov. 23, 2000

(30) Foreign Application Priority Data

May 14, 1999 (IT) ..... RN99A0013

(51) Int. Cl.[7] ..... B67D 3/00

(52) U.S. Cl. ..... 222/529; 222/533; 222/535; 222/541.9; 220/269; 220/270; 229/214

(58) Field of Search ..... 222/529, 533, 222/535, 541.9; 220/269, 270, 705, 717; 229/214, 215, 216, 217, 248

(56) References Cited

U.S. PATENT DOCUMENTS 3,216,609 A * 11/1965 Bogert ..... 220/54
3,473,705 A 10/1969 May et al.
3,481,515 A * 12/1969 Booth et al. ..... 222/529
3,616,961 A * 11/1971 Mallorca ..... 220/54
3,980,214 A * 9/1976 Dahlquist ..... 222/541
4,000,838 A * 1/1977 Bogert ..... 222/529
4,047,647 A * 9/1977 Lewis ..... 222/490
4,111,351 A * 9/1978 Mackierman ..... 229/17
4,561,557 A * 12/1985 Park et al. ..... 220/90.2
5,012,959 A * 5/1991 Gordon ..... 222/535
5,415,313 A * 5/1995 Sang-Seo ..... 220/269
5,556,004 A * 9/1996 Brucker ..... 222/81
6,152,360 A * 11/2000 Block et al. ..... 229/215
6,250,491 B1 * 6/2001 Lee ..... 220/269

* cited by examiner

*Primary Examiner*—Gene Mancene
*Assistant Examiner*—Frederick C Nicolas
(74) *Attorney, Agent, or Firm*—Browdy and Neimark, P.L.L.C.

(57) ABSTRACT

A tear-off opening device for drink cans by means of a tab (1) with grip device (2) for tearing, comprising, underneath the tab (1), a shaped lamina (4), secured underneath the lid (6) for a segment (41) which partially surrounds the edge of the opening (3), whilst at least a remaining segment (42) stays free, the lamina (4) having a conformation that is able to vary from a first stable configuration in which, with the can closed, it is drawn up underneath the tab (1), to successive and transitory configurations that take place during the extraction of the lamina (4) through the opening (3) and to a final stable configuration in which, with the extraction completed, the lamina (4) constitutes a stable spout (8) with related opening (9) whose free edges belong to the free segment (42) of the lamina (4).

33 Claims, 2 Drawing Sheets

TEAR-OFF DEVICE FOR OPENING DRINK CANS

The present application is the national stage under 35 U.S.C. 371 of international application PCT/IB00/00365, filed Mar. 28, 2000 which designated the United States, and which international application was published under PCT Article 21(2) in the English language.

TECHNICAL FIELD

The present invention relates to a tear-off device for opening drink cans, comprising a tab with grip device for tearing, able to place in communication the interior with the exterior of the can, by means of a corresponding opening.

BACKGROUND ART

Devices for opening drink cans are generally constituted by a grip system, usually in the form of a ring, welded or connected to a tear-off tab of various shapes and sizes. The traction of the grip devices causes the tab to be tom off and an opening to be obtained in the lid of the can, which allows the discharge of the drink contained therein.

In the prior art for the practical realisation of such a device more pertinent to the present invention, the grip device, in rising, drags the tab with it, tearing it from the lid until its full detachment. Depending on the conformation of the tab, the opening thereby produced can have various shapes and involve in full or in part the area of the lid of the can. The most common realisations, in cans or containers of cylindrical shape, lead to the formation of openings that are either circular, on in the form of a strip of variable length. The tearing action, if it is not sufficiently controlled, is quite sudden and can, especially if the tab is considerably large relative to the lid, be hazardous: the edges of the tab are generally sharp and, therefore, potentially able to inflict cuts. The edges of the opening thereby produced are also sharp and, hence, potentially able to inflict cuts to the person who handles the open container or places his/her lips close to the opening to drink its content without spilling it. When it flows out of the opening, the drink generally comes in contact with the outer part of the lid. Moreover, in order to drink the content of the can directly, one is forced to place one's lips close both to the external part of the lid and to the cylindrical walls of the container. The drink may thus be contaminated or a non hygienic contact for one's lips may take place.

A subsequent and alternative realisation provides for the grip device, in rising, to thrust the tab (which in this case usually has rounded shape and limited size) inside the container. In this way, the opening is obtained without removing the tab, thereby avoiding the risk of injuries. This solves the problem of the safety of the opening, but not the hygienic problem, which in fact is aggravated: in flowing out of the opening, the drink still generally comes in contact with the external part of the lid; in order to drink the content of the can directly, one is still forced to place one's lips both to the external part of the lid and to the cylindrical walls of the container; in addition, the tab is immersed in the drink with the consequent potential contamination thereof. <Insert page 2a>

DISCLOSURE OF INVENTION

The aim of the present invention, therefore, is to eliminate the aforementioned drawbacks. The invention, as it is characterised by the claims, solves the problem of providing a tear-off opening device for drink cans, comprising a tab with grip device for tearing, able to place in communication the interior with the exterior of the can, by means of a corresponding opening and automatically to form a stable spout, provided with opening for the outflow of the drink, without the drink or a drinker's lips coming in contact with parts of the can exposed to the external environment before the opening of the can itself.

The advantages obtained by means of the present invention essential consist of the fact that, thanks to the presence and to the particular way whereby the spout is formed, the following are guaranteed: the orderly and uniform outflow of the drink from the can; the hygiene of use of the can for pouring the drink it contains into another container; the hygienic contact for the lips when drinking directly from the can. Also prevented, during the outflow, are spillage or discharges of drink outside In document U.S. Pat. No. 3,473,705 a container is disclosed having a pull tab type tear strip for providing an opening in the container on removal of said tear strip, wherein, when the container is closed, a substantially flat flexible body portion is located within the container adjacent and in substantial parallelism with the underside of the lid of the container. In that configuration, the body portion is supported at one end by the tear strip itself and, at the opposite end by a bead connected to the lid. Tearing off the strip causes said body portion to be raised and deformed from its substantially flat condition to a spout-like shape by cooperation between the tearing action and the engagement with the sides of the opening formed on removal of the tear strip. During this operation, the opposite ends of the bead move toward the opening, to let two notches engage the edge of the opening itself, thus providing a stop for limiting further movement of the body portion, so that tear strip may break-away therefrom without pulling the spout from the container. Only part of the bead (namely the central part) remains connected to the lid and retains one end of the body portion within the container. The risk to separate the spout from the can is not completely avoided, due to the conformation of the notches and to the small connection between the bead and the lid. The spout has a structure which is interrupted in correspondence of the edges of the opening and, therefore, there is the risk of spilling the liquid contained in the can along the external side of the lateral parts of the spout itself, when the liquid is poured for drinking. the spout. Another advantage obtained by means of the present invention essentially consists of the fact that, thanks to the characteristics of the spout and to the succession of transitory configurations followed during the phase whereby it is formed, it is possible to minimise the risk of cuts or small injuries when tearing the tab or contacting the opening with the lips.

DESCRIPTION OF THE DRAWINGS

The invention is described more in detail hereafter with the aid of the drawings which represent embodiments provided purely by way of non limiting examples, in which.

DESCRIPTION OF THE ILLUSTRATIVE EMBODIMENTS

Figure 3:
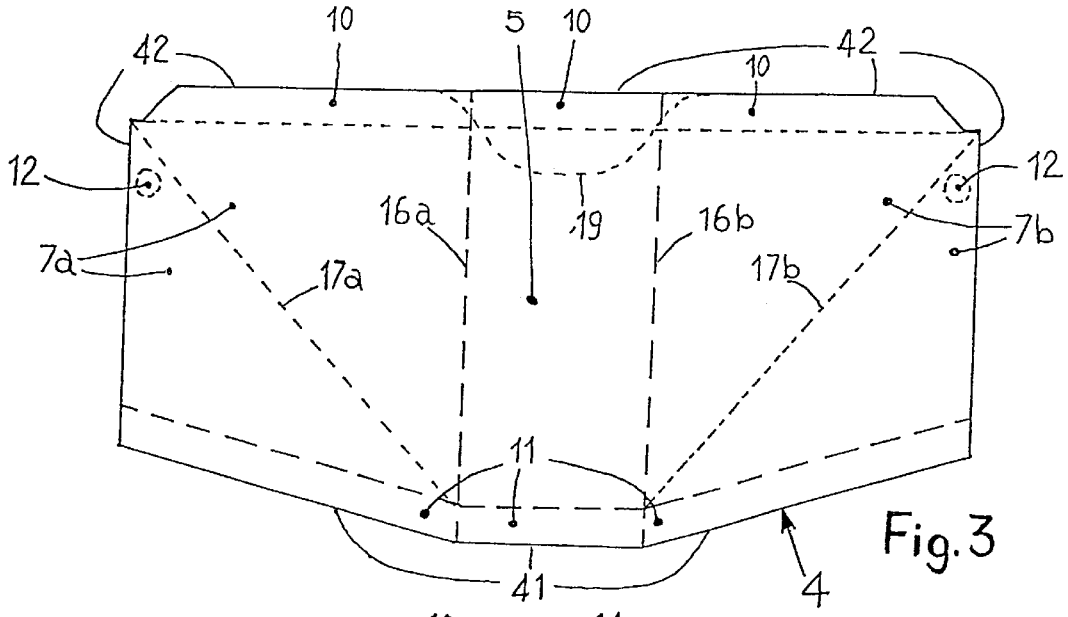
FIG. 3 shows a plan development of the lamina that is shaped into a spout upon opening.
Figure 4:
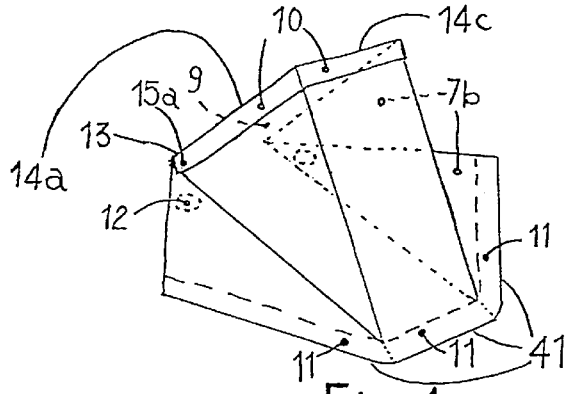
FIG. 4 is a perspective spatial representation of the lamina shaped as a spout removed from the can.
Figure 1:
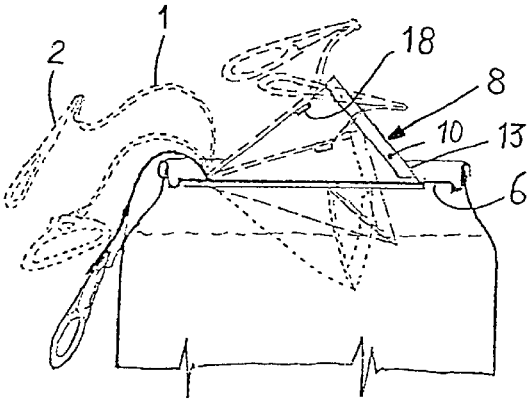
FIG. 1 shows a side view of the area of the lid of the can, illustrating the tearing dynamics of the tab, as well as the initial configuration, an intermediate transitory configuration during extraction and the final shape configuration of the spout after extraction.
Figure 2:
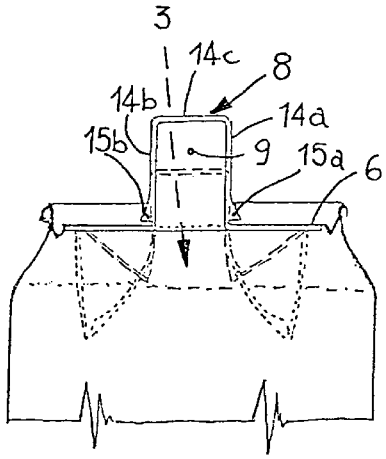
FIG. 2 shows a front view of the area of the lid of the can of FIG. 1 above.
Figure 5:
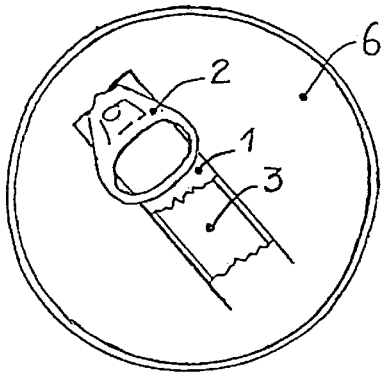
FIG. 5 shows a plan view of the lid of the can, highlighting the tear-off tab, the corresponding grip device and the opening underlying the tab.
Figure 8:
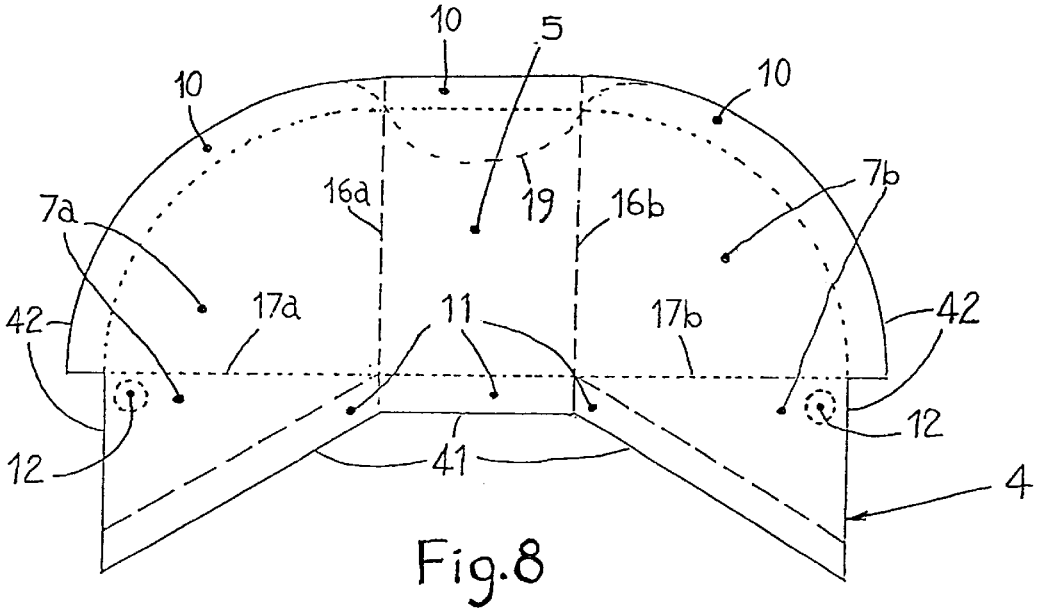
FIG. 8 shows a plan development of the lamina used as per FIG. 6.
Figure 6:
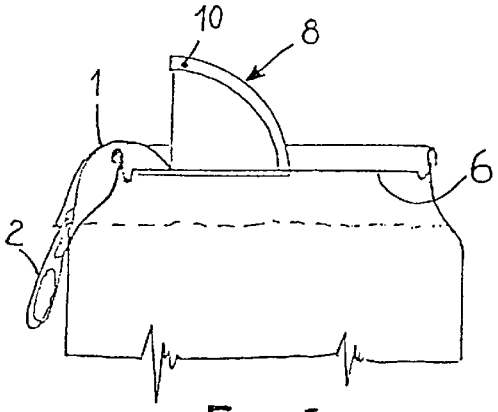
FIG. 6 shows a side view of the area of the cover of the can, illustrating an alternative embodiment of the invention.
Figure 7:
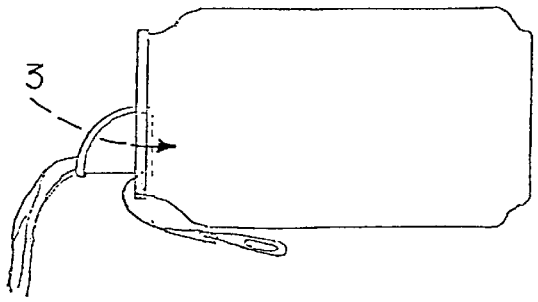
FIG. 7 shows the manner in which the spout is used.

As the figures show, the present invention is constituted, in principle, by a tear-off opening device for drink cans, comprising a tab (1) with grip device (2) for tearing, able to place in communication the interior with the exterior of the can, by means of a corresponding opening (3). Underneath the tab (1) is situated a lamina (4), shaped and secured underneath the lid (6) for a segment (41) which partially surrounds the edge of the opening (3), whilst at least a remaining segment (42) stays free. As shown in FIG. 1 and in FIG. 2, the lamina (4) has a variable conformation. It passes from a first stable configuration in which, with the can closed, it is drawn up underneath the tab (1), to successive and transitory configurations which take place during the extraction of the lamina (4) through the opening (3) and to a final, stable configuration, when the extraction is complete. In this stable final configuration, the lamina (4) forms a stable spout (8), with related opening (9) whose free edges belong to the free segment (42) of the lamina (4). Until the time of opening, therefore, the lamina (4) does not come in contact with the exterior. Hence, once conformed, the spout (8) guarantees the hygienic outflow of the drink, during which, as shown in FIG. 7, the drink itself does not come in contact with any of the exterior parts of the can. The spout (8), moreover, offers, to the lips of those who drink the content using it directly, a hygienic contact area, constituted by the extracted part of the free segment (42) of the lamina (4). Through its opening (9), the spout (8) also guarantees the entry of air into the can and, therefore, the orderly and uniform outflow of the drink. In a preferred embodiment of the present invention, the lamina (4), as shown in FIG. 3 and in FIG. 4, ideally comprises three parts: a central part (5) corresponding to the opening (3) produced by tearing the tab (1) off, two lateral parts **(7*a*, 7*b*), symmetrical relative to the central part (5). These parts (5, 7*a*, 7*b*) are secured to the inner face of the lid (6), along their related portion of the segment (42)of the lamina (4), as shown in the aforesaid FIGS. 3 and 8. Said securing can be obtained in several ways: by junction, gluing or welding; in spots or in continuous segments. In a preferred and more effective embodiment of the present invention, the union is obtained by means of a hermetically sealed continuous structure, obtained by joining the segment (11) of the lamina (4) to the inner face of the lid (6). The lamina (4) can be obtained using metallic, plastic, or rubber materials. Such materials must be easy to shape, deform and fold without breaking, while maintaining a certain mechanical solidity. Moreover, they must not be toxic or polluting for the drink contained in the can. In its first stable configuration, the lamina (4) is folded in correspondence with the lines (16*a*, 16*b*) on the border between its central part (5) and its lateral parts (7*a*, 7*b*). The lateral parts (7*a*, 7*b*) thereby project inwards. In turn, they are also folded along the lines (17*a*, 17*b*) towards the inner part of the lid (6) in order to rejoin said lid (6) along the segment portion (41) of the lamina (4), to obtain the union with the lid (6) itself. The portion of the free segment (42) of the lamina (4) pertaining to the lateral parts (7*a*, 7*b*) thus projects inwards, allowing the central part (5) of the lamina (4) to remain underneath the tab (1) itself. The creases along the lines (16*a*, 16*b*, 17*a*, 17*b*) and the resulting shaping of the lamina (4) cause the central part (5) of the lamina (4), in non-extracted position, to remain barely underneath and parallel to the plane of the lid (6), thereby offering an ample contact area to the tear-off tab (1). In the intermediate configurations, during extraction, the central part (5) is lifted, dragging therewith, through the opening (3), the rest of the lamina (4). In the final stable configuration of the lamina (4), corresponding to the completed full extraction, the portions of the lateral parts (7*a*, 7*b*), lying between the junction (11) and the crease lines (17*a*, 17*b*), come to rest on the inner face of the lid (6). This prevents, together with the presence of the union (11), the removal of the lamina (4) from the can. The central part (5), at its maximum extraction, constitutes the bottom of the spout (8), whose side walls are constituted by the extracted portion of the lateral parts (7*a*, 7*b*) of the lamina (4). The free edges of the bottom (14*c*) and of the side walls (14*a*, 14*b*) of the spout (8) define the contour of the opening (9) for the outflow of the drink. In a preferred and more effective embodiment of the invention, the tear-off tab (1) is secured to the lamina (4). This union (18) can be obtained in various ways and with various techniques. It allows, upon tearing the tab off, to extract the lamina (4) automatically and, thus, to configure the spout (8) automatically. In this case, the central part (5) of the lamina (4), in non extracted position, can close the entire opening (3), providing a longer and thus more useful spout (8). The union (18) between tab (1) and lamina (4) must at the same time be sufficiently strong to allow the entire extraction of the lamina (4) and sufficiently weak to yield, after the extraction of the lamina (4) and the stable formation of the spout (8). In an alternative embodiment of the present invention the central part (5) of the lamina (4), in non extracted position, does not close the whole opening (3): the unobstructed part of the opening allows, in the absence of the union (18), the grip of the segment (19) of the edge and, hence, the extraction of the lamina (4); The shaping of the lamina (4) and its interaction with the edge of the opening (3) in the succession of transitory configurations followed during the spout (8) shaping phase, make the extraction not sudden, thereby reducing the risk of injuries. Thanks to the shaping and folding of the lamina (4), during the extraction the free portion of the perimeter of the lateral parts (7*a*, 7*b*) projects towards the interior of the can. Moreover, their surfaces remain inclined towards the interior of the can, until checked on the inner face of the lid (6). This allows, during the extraction, to let any liquid trapped by the lamina (4) itself, due to the movements whereto the can was subjected before its opening, drain inwards. In an embodiment of the present invention, in the portion of each of the lateral parts (7*a*, 7*b*) which, at the end of the lamina extraction phase (4), come to rest against the inner face of the lid (6), one or more holes (12) are obtained, of adequate dimensions and in such a position as to prevent them from being involved during he orderly outwards flow of the drink. In this way it is possible to drain more effectively inwards any liquid which may be trapped by the lamina (4), preventing outward splashes if the lamina (4) is extracted too rapidly. In a preferred and more effective embodiment of the present invention, the lateral parts (7*a*, 7*b*) of the lamina (4) present means (13) for geometrically interfering with the lid (6), such as to prevent it from returning into the can, once extracted, and to make the spout stable (8). This also makes stable the intimate contact obtained between the inner surface of the lid (6) and the part of lamina (4) which remains inside, by effect of the check subsequent to the extraction. This contact, together with the continuity and hermetic seal of the union (11) to the inner surface of the lid (6), guarantee that, during the outflow, no spillage or release of the drink outside the spout (8) will occur. In a preferred embodiment of the present invention, the geometric interference means (13) are obtained along the free lateral edges (14***a*, 14*b*) of the spout (8), and are constituted by at least two corresponding interference elements (15*a*, 15*b*), elastically movable from a first position of non interference during the extraction of the spout (8), to a second extreme position of geometric interference with the lid (6) of the can. These interference elements can be obtained in various ways: for instance, by punching, if the lamina (4) is metallic. In a preferred and more effective embodiment of the present invention, the free edges (14*a*, 14*b*, 14*c*) that comprise the contour of the opening (9), have a flap (10), towards the exterior of the spout (8) which rounds their edges. This constitutes, for the user's lips, a contact area free of injury hazards. The geometric interference means (13) can be obtained from the flap (10). FIGS. 2 and 4 show a particular manner for obtaining the interference means (13), by slightly folding outwards the beaks of the flap (10), to obtain the interference means (15*a*, 15*b*).

The invention thus conceived can be subject to numerous modifications and variations, without thereby departing from the scope of the inventive concept. Moreover, all components can be replaced by technically equivalent elements.

In practice, modifications and/or improvements are obviously possible, without thereby departing from the scope of the claims that follow.

What is claimed is:

1. A tear-off opening device for a drink can comprising a tab (1) with grip device (2) for tearing off, able to place in communication an interior with an exterior of the can, by means of a corresponding opening (3), a shaped lamina (4) being positioned underneath the tab (1) and secured underneath a lid (6) for a segment (41) that partially surrounds the edge of an opening (3), whilst at least a remaining segment (42) stays free, said lamina (4) having a conformation able to vary from a first stable configuration in which, with the can closed, it is drawn up underneath the tab (1), to successive and transitory configurations that take place during an extraction of the lamina (4) through the opening (3) and to a final stable configuration in which, with the extraction completed, the lamina (4) forms a stable spout with related opening (9) whose free edges belong to the free remaining segment (42) of the lamina (4), wherein the lamina (4) is ideally composed by three parts: a central part (5), corresponding to the opening (3) produced by a tearing of the tab (1) and secured to an inner face of the lid (6) at least along its own segment opposite to the one corresponding to the device (2) for gripping the tab (1) itself, two lateral parts (7*a*, 7*b*), symmetrical relative to the central part (5), each secured to the inner face of the lid (6) of the can for a certain segment of their perimeter starting from the union of the central part (5); in said first stable configuration the lamina (4) being with its own lateral parts (7*a*, 7*b*) folded, in such a way that the free portion of their perimeter projects inwards, allowing the central part (5) of the lamina (4) to remain underneath the tab (1) itself; in said final stable configuration the lamina (4) having, when the extraction has been completed, at least its own portions of said lateral parts (7*a*, 7*b*) in contact against the inner face of the lid (6), whilst the spout (8) comprises a bottom constituted by the central part (5) and lateral walls constituted by the extraction portion of the lateral parts (7*a*, 7*b*), the free edges of the bottom and the lateral walls defining a contour of the opening (9) for an outflow of a drink, wherein the lateral walls (7*a*, 7*b*) of the lamina (4) have geometric interference means (13) for providing geometric interference with the lid (6), such as to prevent it from re-entering the can once extracted and to render the spout (8) stable.

2. The device according to claim 1, wherein the geometric interference means (13) are obtained along the free lateral edges (14*a*, 14*b*) of the spout (8), and are constituted by at least two corresponding interference elements (15*a*, 15*b*), elastically movable from a first position of non interference during the extraction of the spout (8), to a second extreme position of geometric interference with the lid (6) of the can.

3. The device according to claim 2, wherein the free edges of the opening (9) present a flap (10) towards the exterior of the spout (8) which rounds its edges and in that the geometric interference means (13) are obtained in correspondence with the flap (10) itself.

4. The device according to claim 2, wherein the interference elements are produced by punching out a lateral wall of the lamina (4).

5. The device according to claim 3, wherein the interference elements are produced by punching out a lateral wall of the lamina (4).

6. The device according to claim 3, wherein the interference elements are produced by folding beaks of the flap outwards.

7. The device according to claim 1, wherein said free edges of the opening (9) present a flap (10) towards the exterior of the spout (8) which rounds its edges.

8. The device according to claim 1, comprising a union (11) of the central part (5) and of the lateral parts (7*a*, 7*b*) to the inner face of the lid (6) constituted by a single continuous structure.

9. The device according to claim 2, comprising a union (11) of the central part (5) and of the lateral parts (7*a*, 7*b*) to the inner face of the lid (6) constituted by a single continuous structure, wherein said geometric interference means (13) are obtained along the free lateral edges (14*a*, 14*b*) of the spout (8), and are constituted by at least two corresponding interference elements (15*a*, 15*b*), elastically movable from a first position of non-interference during the extraction of the spout(8), to a second extreme position of geometric interference with the lid (6) of the can.

10. The device according to claim 2, comprising a union (11) of the central part (5) and of the lateral parts (7*a*, 7*b*) to the inner face of the lid (6) constituted by a single structure wherein the free edges of the opening (9) present a flap (10) towards the exterior of the spout (8) which rounds its edges and in that the geometric interference means (13) are obtained in correspondence with the flap (10) itself.

11. The device according to claim 1, wherein, during the extraction of the lamina (4), the free portion of the perimeter of the lateral parts (7*a*, 7*b*) projects towards the interior of the can and in that the surfaces of said parts are inclined towards the interior of the can, until checked by the inner face of the lid (6).

12. The device according to claim 2, wherein, during the extraction of the lamina (4), the free portion of the perimeter of the lateral parts (7*a*, 7*b*) projects towards the interior of the can and in that the surfaces of said parts are inclined towards the interior of the can, until checked by the inner face of the lid (6), wherein, said geometric interference means (13) are obtained along the free lateral edges (14*a*, 14*b*) of the spout (8), and are constituted by at least two corresponding interference elements (15*a*, 15*b*), elastically movable from a first position of non interference during the extraction of the spout(8), to a second extreme position of geometric interference with the lid (6) of the can.

13. The device according to claim 3, wherein, during the extraction of the lamina (4), the free portion of the perimeter of the lateral parts (7*a*, 7*b*) projects towards the interior of the can and in that the surfaces of said parts are inclined towards the interior of the can, until checked by the inner face of the lid (6), wherein the free edges (contour) of the opening (9) present a flap (10) towards the exterior of the spout (8) which rounds its edges and in that the geometric interference means (13) are obtained in correspondence with the flap (10) itself.

14. The device according to claim 8, wherein, during the extraction of the lamina (4), the free portion of the perimeter of the lateral parts (7*a*, 7*b*) projects towards the interior of the can and in that the surfaces of said parts are inclined towards the interior of the can, until checked by the inner face of the lid (6).

15. The device according to claim 9, wherein, during the extraction of the lamina (4), the free portion of the perimeter of the lateral parts (7*a*, 7*b*) projects towards the interior of the can and in that the surfaces of said parts are inclined towards the interior of the can, until checked by the inner face of the lid (6), wherein the free edges of the opening (9) present a flap (10) towards the exterior of the spout (8) which rounds its edges and in that the geometric interference means (13) are obtained in correspondence with the flap (10) itself.

16. The device according to claim 10, wherein, during the extraction of the lamina (4), the free portion of the perimeter of the lateral parts (7*a*, 7*b*) projects towards the interior of the can and in that the surfaces of said parts are inclined towards the interior of the can, until checked by the inner face of the lid (6), wherein the free edges of the opening (9) present a flap (10) towards the exterior of the spout (8) which rounds its edges and in that the geometric interference means (13) are obtained in correspondence with the flap (10) itself.

17. The device according to claim 1, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6).

18. The device according to claim 8, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6), wherein said geometric interference means (13) are obtained along the free lateral edges (14*a*, 14*b*) of the spout (8), and are constituted by at least two corresponding interference elements (15*a*, 15*b*), elastically movable from a first position of non interference during the extraction of the spout(8), to a second extreme position of geometric interference with the lid (6) of the can.

19. The device according to claim 3, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6), wherein the free edges of the opening (9) present a flap (10) towards the exterior of the spout (8) which rounds its edges and in that the geometric interference means (13) are obtained in correspondence with the flap (10) itself.

20. The device according to claim 8, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6).

21. The device according to claim 9, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6), wherein said geometric interference means (13) are obtained along the free lateral edges (14*a*, 14*b*) of the spout (8), and are constituted by at least two corresponding interference elements (15*a*, 15*b*), elastically movable from a first position of non-interference during the extraction of the spout (8), to a second extreme position of geometric interference with the lid (6) of the can.

22. The device according to claim 10, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6), wherein the free edges of the opening (9) present a flap (10) towards the exterior of the spout (8) which rounds its edges and in that the geometric interference means (13) are obtained in correspondence with the flap (10) itself.

23. The device according to claim 11, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6).

24. The device according to claim 12, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6), wherein said geometric interference means (13) are obtained along the free lateral edges (14*a*, 14*b*) of the spout (8), and are constituted by at least two corresponding interference elements (15*a*, 15*b*), elastically movable from a first position of non interference during the extraction of the spout(8), to a second extreme position of geometric interference with the lid (6) of the can.

25. The device according to claim 13, wherein one or more holes (12) are obtained, of adequate dimensions and in such a position as to prevent them from being involved during an orderly outward flow of the drink, in the portions of each of the lateral parts (7*a*, 7*b*) which, at the end of the lamina extraction phase (4), are checked by the inner face of the lid (6), wherein the free edges of the opening (9) present a flap (10) towards the exterior of the spout (8) which rounds its edges and in that the geometric interference means (13) are obtained in correspondence with the flap (10) itself.

26. The device according to claim 1, wherein the tear-off tab (1) is secured to the lamina (4) in such a way as to allow, during the tearing operation, the automatic extraction of said lamina (4), said union being simultaneously sufficiently strong to allow the full extraction of the lamina (4) and sufficiently weak to yield, after the extraction of the lamina (4) and the stable formation of the spout(8).

27. The device according to claim 26, wherein said lateral walls (7*a*, 7*b*) are folded in such a way that the central part (5) of the lamina (4), in a non-extracted position, is barely underneath and parallel to the plane of the lid (6), thus providing an ample contact area to the tear-off tab.

28. The device according to claim 27, wherein the central part (5) of the lamina (4) in a non-extracted position, encloses the entire opening (3).

29. The device according to claim 7, wherein said lateral walls (7*a*, 7*b*) are folded in such a way that the central part (5) of the lamina (4), in a non-extracted position, remains barely underneath and parallel to the plane of the lid (6), closing only part of the opening (3), in order to provide a grip for manual extraction.

30. The device according to claim 7, wherein said lateral walls (7*a*, 7*b*) are folded in such a way that the central part (5) of the lamina (4), in a non-extracted position, remains barely underneath and parallel to the plane of the lid (6), closing only part of the opening (3), in order to provide a grip for manual extraction.

31. The device according to claim 20, wherein said lateral walls (7*a*, 7*b*) are folded in such a way that the central part (5) of the lamina (4), in a non-extracted position, remains barely underneath and parallel to the plane of the lid (6), closing only part of the opening (3), in order to provide a grip for manual extraction.

32. The device according to claim 23, wherein said lateral walls (7*a*, 7*b*) are folded in such a way that the central part (5) of the lamina (4), in a non-extracted position, remains barely underneath and parallel to the plane of the lid (6), closing only part of the opening (3), in order to provide a grip for manual extraction.

33. The device according to claim 8, wherein said continuous structure is hermetically sealed relative to the drink.

* * * * *